US010231297B2

(12) United States Patent
Boonen et al.

(10) Patent No.: US 10,231,297 B2
(45) Date of Patent: Mar. 12, 2019

(54) LIGHTING APPARATUS CONTROL SWITCH AND METHOD

(71) Applicant: PHILIPS LIGHTING HOLDING B.V., Eindhoven (NL)

(72) Inventors: Paul Theodorus Jacobus Boonen, Tegelen (NL); Peter Deixler, Valkenswaard (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/778,528

(22) PCT Filed: Nov. 22, 2016

(86) PCT No.: PCT/EP2016/078414
§ 371 (c)(1),
(2) Date: May 23, 2018

(87) PCT Pub. No.: WO2017/089341
PCT Pub. Date: Jun. 1, 2017

(65) Prior Publication Data

US 2018/0359826 A1 Dec. 13, 2018

(30) Foreign Application Priority Data

Nov. 24, 2015 (EP) ..... 15195992

(51) Int. Cl.
*H05B 37/02* (2006.01)
*H05B 33/08* (2006.01)

(52) U.S. Cl.
CPC ..... *H05B 33/0815* (2013.01); *H05B 37/0272* (2013.01); *H05B 33/0848* (2013.01)

(58) Field of Classification Search
CPC ..... H05B 37/0272; H05B 33/0848
See application file for complete search history.

(56) References Cited

U.S. PATENT DOCUMENTS 8,009,042 B2 * 8/2011 Steiner ..... H05B 37/0227 340/541
8,327,159 B2 12/2012 Newman, Jr.
8,446,101 B2 5/2013 Tsui et al.
8,694,807 B2 4/2014 Newman, Jr.
(Continued)

FOREIGN PATENT DOCUMENTS

EP 0618667 A1 10/1994
GB 2444527 A 6/2008
(Continued)

*Primary Examiner* — Thuy Vinh Tran
(74) *Attorney, Agent, or Firm* — Akarsh P. Belagodu

(57) ABSTRACT

The invention provides a lighting apparatus control switch which uses a detection circuit to monitor a parameter which is dependent on the output current flowing to a lighting load when the lighting apparatus control switch is turned off. The lighting apparatus control switch is configured as an on/off controller or a dimming controller in dependence on the monitored parameter. This lighting apparatus control switch can thus be configured as a dimmable switch, for example implementing leading or trailing edge dimming, or as an on/off switch. The lighting apparatus control switch provides a universal dimmer solution which may be future-proof to allow installation of newer generation lighting loads.

11 Claims, 4 Drawing Sheets

(56) References Cited

U.S. PATENT DOCUMENTS

| | | | | |
|---|---|---|---|---|
| 8,823,268 | B2 * | 9/2014 | Saveri, III | H02J 17/00 315/149 |
| 8,892,913 | B2 | 11/2014 | Newman, Jr. et al. | |
| 9,313,859 | B2 * | 4/2016 | Saveri, III | H02J 17/00 |
| 9,743,496 | B2 * | 8/2017 | Knauss | H05B 37/0227 |
| 2010/0244709 | A1 * | 9/2010 | Steiner | G01J 1/02 315/158 |
| 2013/0030589 | A1 | 1/2013 | Pessina et al. | |
| 2013/0278058 | A1 | 10/2013 | Testani | |

FOREIGN PATENT DOCUMENTS

| | | | |
|---|---|---|---|
| SG | 186590 | A1 | 1/2013 |
| WO | 2007029186 | A2 | 3/2007 |
| WO | 2007068040 | A1 | 6/2007 |
| WO | 2012168859 | A2 | 12/2012 |
| WO | 2015145287 | A1 | 10/2015 |

* cited by examiner

LIGHTING APPARATUS CONTROL SWITCH AND METHOD

CROSS-REFERENCE TO PRIOR APPLICATIONS

This application is the U.S. National Phase application under 35 U.S.C. § 371 of International Application No. PCT/EP2016/078414, filed on Nov. 22, 2016, which claims the benefit of European Patent Application No. 1519599.1, filed on Nov. 24, 2015. These applications are hereby incorporated by reference herein.

FIELD OF THE INVENTION

This invention is generally related to a method and apparatus for controlling a lighting apparatus, such as a lamp, luminaire, tubular luminaire, LED module or LED driver.

BACKGROUND OF THE INVENTION

There is an increasing use of LEDs as individual lamps or in luminaires, and which can perform additional functions beyond simple on-off control. Perhaps the most basic function is a dimming function.

Traditional incandescent light bulbs make use of phase-cut dimming approaches, and phase cut dimmer switches are used for this purpose. They may operate according to a leading edge phase cut approach or a trailing edge phase cut approach.

Universal dimmers are very popular among electrical installers. The main reason for this is that they are suitable for inductive, resistive and capacitive lighting loads. This makes life easy for the technician, since the dimmer adapts its operating mode (in particular leading or trailing edge) automatically to the load it is connected to. The installer only has to have one dimmer type in stock.

Lamps and luminaires with wireless control functions, using an on-board radio modem, are becoming more popular, so that there is a trend towards wireless controllable lamps.

The wireless communication usually takes place between the lighting load (e.g. lamp) and a bridge, often known as a hub. The hub is preferably provided as a two-wire device to fit existing electrical installations so that it can be provided as a retrofit solution. The hub is then connected in series with the load, and it has to be powered in order to operate.

However, known universal dimmers cannot operate these wireless lighting loads. Furthermore, available wireless dimmers are not suitable for universal loads. A wireless dimmer in the context of this application is one which is controllable via wireless communication (e.g. ZLL, WiFi or Bluetooth), while the interface to the lighting load is still a phase-cut signal.

Typically a wall switch, such as a dimmer switch, lasts for 20 years and even when it initially will be used with phase-cut dimmable lighting loads, it would be desirable if it could also be used for wireless connected lighting loads.

There is therefore a need for a lighting apparatus control switch that can cover all state of the art technologies. This would then enable ease of installation and avoid confusion at the customer side. The lighting apparatus control switch should be a two-wire unit so that it can replace existing wall switches (where no neutral wire is present) without requiring wiring alterations.

Powering of such a unit can be implemented with batteries or other energy storage or energy harvesting technologies. However, a more user-friendly and maintenance free solution is to power the lighting apparatus control switch directly via the mains. There is therefore a further need for a universal lighting apparatus control switch which can replace existing two-wire wall switches.

GB 2444527 A1 discloses a device for replacing conventional wall mounted light switches in situ comprises a dimmer and an occupancy sensor. The device can vary the power output to a lighting device in response to a manually operable control and also signals generated by the occupancy sensor. The occupancy sensor may be a PIR (passive infrared) type detector. A light sensor and a timer may also be provided. The device may also have two operating regimes, one for incandescent lamps and one for non-incandescent lamps.

SG 186590 A1 discloses a device for controlling an output of a load, the device including: a conduction angle changing circuit; a current scanner; and a digital signal processing unit including: a preset load type acquiring module; and a continuous template matching module adapted to perform continuous template matching at a predetermined timing in an event that the acquired preset load type is a non-linear dimmable load, the continuous template matching module including: a conduction angle range determining sub-module adapted to determine a conduction angle range; a local pattern acquiring sub-module adapted to acquire a local pattern in response to changing the conduction angle within the conduction angle range; a matching submodule adapted to match the local pattern with the local pattern in a current pattern template; and an updating sub-module adapted to update a control parameter for the load in accordance with a matching result.

SUMMARY OF THE INVENTION

It would be advantageous to have a control switch that is compatible with all kinds of loads such as non-dimmable lamp, traditional dimmable lamp (phase-cut dimmable lamp), and wireless controlled lamp.

A basic idea of embodiments of the invention is that using the current from the switching to the load to distinguish the type of the load. This solution is based on a condition that different load would cause the control switch to behave in different manner. For example, a non-dimmable lamp does not support dimmer thus normally would not allow the leak/bypass current of the dimmer; while the dimmable lamp allows leak/bypass current of the dimmer, so as to allow the lead current to charge the triac in the dimmer and make the dimmer operate normally.

The invention is defined by the claims.

According to examples in accordance with an aspect of the invention, there is provided a lighting apparatus control switch, comprising:

- a power input terminal for receiving power from an external power source;
- an output terminal for connection to a lighting load;
- a detection circuit for detecting a parameter which is dependent on an output current flowing to the output terminal with the lighting apparatus control switch turned off; and
- a controller, which is adapted to:
  - configure the lighting apparatus control switch as an on/off controller or a dimming controller according to the detected parameter.

Given the presence/amplitude of the output current when the control switch is turned off, the control switch can determine whether the light load supports the leak current when the control switch is turned off, and in turn can determine whether the lighting load can support dimmer. Accordingly, this switch can be configured as a dimmable switch, for example implementing leading or trailing edge dimming, to operate the dimmable lighting load, or it may be configured to implement an on/off switch to operate the non-dimmable light load. The switch provides a universal switch solution which may be future-proof to allow installation of newer generation/dimmable lighting loads as well as basic non-dimmable lighting load.

The controller may be adapted to:

determine a type of lighting load based on the parameter, wherein the type of lighting load is determined to be a dimmable lighting load if the parameter exceeds a threshold, or a non-dimmable lighting load if the parameter is below the threshold; and configure the lighting apparatus control switch as the on/off controller for the non-dimmable lighting load or as the dimming controller for the dimmable lighting load.

In this switch, the controller automatically detects if a connected lighting load is a dimmable or non-dimmable type of lighting load according to the output current. A dimmable lighting load is detected based on allowing a sufficient bypass current to flow when the lighting apparatus control switch is off.

The determining and configuring carried out by the controller for example takes place during a start-up mode of the switch.

The power input terminal may be for receiving an alternating mains input, the controller is adapted to implement a phase cut to the mains input, and the lighting apparatus control switch is turned off in the phase cut, wherein the control switch comprises a charge storage element which is charged by said output current during the phase cut to provide a power supply for the detection circuit and controller.

In this way, a phase cut is used as a way to generate the required power for the switch to function. This avoids the need for a battery or other non-permanent power source. Instead, the charge storage element may simply comprise a suitable capacitor, with suitable control electronics, such as a rectifier and switch mode or linear power converter.

The parameter may comprise a state of charge of the charge storage element.

Thus, the way the charge storage element is charged provides an indication of the output current that is able to flow and thus indicates the bypass current which is able to flow through the lighting load. Alternatively, a dedicated resistive element can be placed to allow the output current goes through, and the voltage across the resistive element is an indication of the output current.

The control switch may comprise a series switch arrangement between the power input terminal and the output terminal.

This series switch arrangement can function as an on-off switch or else it can be controlled more dynamically to implement phase cut dimming control.

The control switch may further comprise an RF transceiver, wherein the controller is further adapted to determine if a dimmable lighting load is an RF dimmable lighting load by attempting RF communication with the lighting load.

In this way, the control switch can determine if a dimmable lighting load has local RF controlled dimming capability. This gives the control switch even more universal applicability.

The overall control switch may thus function as an electronic switch or as a controller for controlling wireless lighting loads. Control can take place from the lighting apparatus control switch itself or via an external device, for which the lighting apparatus control switch then acts as a hub.

The control switch may thus be based on a two-wire wireless lighting apparatus control switch (with phase-cut functionality to generate its power supply as explained above). Phase-cut dimming functionality is then provided which may use the same hardware and control.

The controller may be adapted to configure the lighting apparatus control switch as:

a wireless intermediary for an RF dimmable lighting load if the RF communication with the lighting load succeeds; otherwise as a phase cut dimmer if the RF communication with the lighting load fails.

The control switch then functions as a hub, bridge or other wireless intermediary for an RF dimmable lighting load, or as a phase cut dimmer otherwise.

When the controller is adapted to configure the lighting apparatus control switch as a phase cut dimmer, the controller is for example further adapted to: determine if the load is a leading edge load or a trailing edge load, and configure the lighting apparatus control switch as a leading edge dimmer or a trailing edge dimmer accordingly.

In this way, there is a detection system to automatically detect which kind of load (for example dimmable or non-dimmable, and also inductive, resistive, capacitive or wireless) is connected.

The controller may be adapted to switch off the load and/or display a notification if the parameter drops below a minimum value even smaller than the threshold.

This function enables an automatic switch off mode to be implemented.

The control switch may have a single input terminal and a single output terminal. In this way, the switch functions as a 2 wire lighting apparatus control switch, which can be used as a retrofit to existing lighting switch housings.

The invention also provides a lighting system, comprising a control switch as defined above and a lighting load connected to the output terminal, wherein the lighting load comprises one of:

a phase-cut dimmable lighting load having a current bypass function;

a non-dimmable lighting load having no current bypass function;

a RF dimmable lighting load with RF communications capability and having a current bypass function.

This provides the combination of a control switch and the lighting load controlled by the switch.

Examples in accordance with another aspect of the invention provide a lighting apparatus control method, comprising:

detecting a parameter dependent on an output current flowing from a lighting apparatus control switch to a lighting load with the lighting apparatus control switch turned off; and configuring the lighting apparatus control switch as an on/off controller or a dimming controller according to the parameter.

The method may further comprise determining the type of lighting load based on the parameter by determining the lighting load to be a dimmable lighting load if the parameter exceeds a threshold, or a non-dimmable lighting load if the parameter is below the threshold.

This method makes use of detection (direct or indirect) for example of a bypass current past a lighting load (i.e. a current which flows even with the lighting load turned off). It enables automatic detection of the type of lighting load.

The method may further comprise determining if a dimmable lighting load is an RF dimmable lighting load by attempting RF communication with the lighting load and configuring the lighting apparatus control switch as a wireless intermediary for an RF dimmable lighting load if the RF communication succeeds.

An alternating mains input may be received by the lighting apparatus control switch and a phase cut may be implemented to the mains input, wherein the method further comprises charging a charge storage element from the input during the phase cut to provide a power supply for the lighting apparatus control switch, and wherein the parameter comprises a state of charge of the charge storage element.

The method may then comprise:

- applying a first threshold to the parameter below which a malfunction is detected;
- applying a second threshold to the parameter, wherein a non-dimmable lighting load is determined when the parameter is between the first and second thresholds;
- if the second threshold is passed, performing a phase cut dimming test to determine if the power supply remains stable and:
  - if the power supply remains stable:
    - attempting RF communication with the lighting load and configuring the lighting apparatus control switch as a wireless intermediary for an RF dimmable lighting load if RF communication is established and if RF communication is not established, performing load detection for inductive, resistive or capacitive lighting loads and selecting leading edge or trailing edge dimming accordingly;
  - if the power supply does not remain stable, configuring the lighting apparatus control switch as an on/off controller.

This test ensures that using a phase cut for power generation in the lighting apparatus control switch enables sufficient power for the lighting apparatus control switch to function as a dimmer. Thus, even if a dimmable lighting load is detected, the control switch must be able to generate sufficient power during the phase cut to perform its electronic functions.

If a dimmable lighting load is detected which requires a phase cut dimming control, the type of phase cut needed is then determined. Thus, the method is also able to distinguish between different types of lighting load needing different phase cut types.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting apparatus control switch which uses a detection circuit to monitor a parameter such as an output current flowing to a lighting load when the lighting apparatus control switch is turned off. The lighting apparatus control switch is configured as an on/off controller or a dimming controller in dependence on the monitored parameter (i.e. a current or indirectly a monitored power supply voltage), since the monitored parameter is relevant with whether the lighting load is dimmable. This lighting apparatus control switch can thus be configured as a dimmable switch, for example implementing leading or trailing edge dimming to be used with dimmable lighting loads, or as an on/off (electronic) switch to be used with non-dimmable lighting loads. The lighting apparatus control switch provides a universal switch solution which may be future-proof to allow installation of newer generation lighting loads and basic non-dimmable lighting loads.

Figure 1:
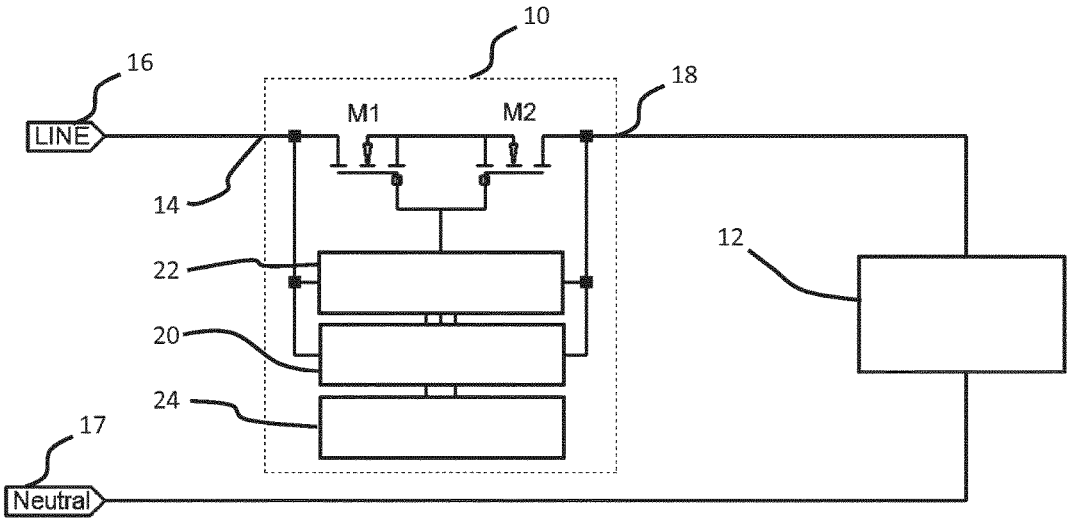
FIG. 1 shows a lighting apparatus control switch for providing power to a lighting load.

FIG. 1 shows a lighting apparatus control switch 10, from this point referred to more simply as a lamp control switch 10, for providing power to a lighting load 12, from this point referred to more simply as a lamp 12.

The lamp control switch 10 comprises a power input terminal 14 for receiving power from an external power source 16 and an output terminal 18 for connection to the lamp 12. The other lamp terminal is connected to a neutral line 17.

A controller 20 is used for detecting a parameter which is dependent on an output current flowing to the output terminal 18 with the lamp control switch turned off. Here the term lamp control switch turned off means the substantial conducting element is turned off, for example, in a triac dimmer, the triac component is turned off. However, it should be understood that in a condition of the substantial conducting element is turned off, there is a bypass/leak current path between the input mains and the lighting load and there is bypass/output current flowing in this path so as to turn on the substantial conducting element when a condition such as phase cut degree is met. The parameter for example is a charging voltage caused by the output current. This output current is thus a bypass current which is able to pass through the lamp circuit. The controller functions as a detector but also as a controller to configure the lamp control switch as an on/off controller or a dimming controller according to the parameter. The detection circuit is shown as part of the controller 20, but they may be separate units.

The lamp control switch 10 has a power supply section 22 which may comprise a bridge rectifier with a storage capacitor, a current limiting element and a linear converter or switch mode power supply to convert to a desired DC voltage (e.g. 5V or 3.3V). A power supply with high power factor is preferred, for example to limit the peak rectification charging current into the lighting load.

The lamp control switch 10 has a series switch arrangement between the input terminal 14 and the output terminal 18, shown as first and second transistors M1 and M2. They are controlled to implement phase-cut functionality. In particular, an alternating mains input is received at the input 14, and the controller 20 implements a phase cut to the mains input. The lamp control switch is turned off in the phase cut. However, during this time, a charge storage element of the power supply section 22 is charged by the output (bypass) current to provide a power supply, via the two terminals of the power supply section 22 respectively connected to the input 14 and the output 18.

In this example metal oxide field effect transistors, MOSFETs, are used, but in principle any other semiconductor could be applied (e.g. bipolar junction transistors, BJTs, or a rectifier bridge with a single MOSFET or BJT). In general MOSFET technology is preferred due to the relatively low power consumption.

The power supply section 22 and controller 20 are interconnected to provide the supply power and to sense the supply voltage behavior over time, as discussed further below.

The controller implements timing and control functions, to control the switches M1 and M2, to determine the operation mode for example based on power supply voltage sensing, to sense the mains zero crossings for timing synchronous to the mains frequency and also to implement decision making as discussed below.

The lamp control switch further comprises a wireless function block 24 which implements wireless connectivity. It is connected to the power supply section 22 to be powered and to the controller 20, since this unit decides whether or not the wireless mode has to be activated. The wireless function block may also provide instructions to the controller, for example to adjust the phase-cut angle.

The lamp control switch is designed to implement an automatic detection principle, for fitting in a two-wire lamp control switch, to decide when to operate using three different modes:

1. An on-off switch mode to control a non-dimmable lighting load (non-dimmable LED lamp);
2. A leading or trailing edge phase-cut dimmer to dim a phase-cut dimmable lighting loads (e.g. dimmable LED lamp, CFLi and incandescent lamps);
3. An RF node/hub/bridge for wireless controllable lighting loads, using a minimal phase-cut to generate power supply in the lamp control switch.

Figure 2:
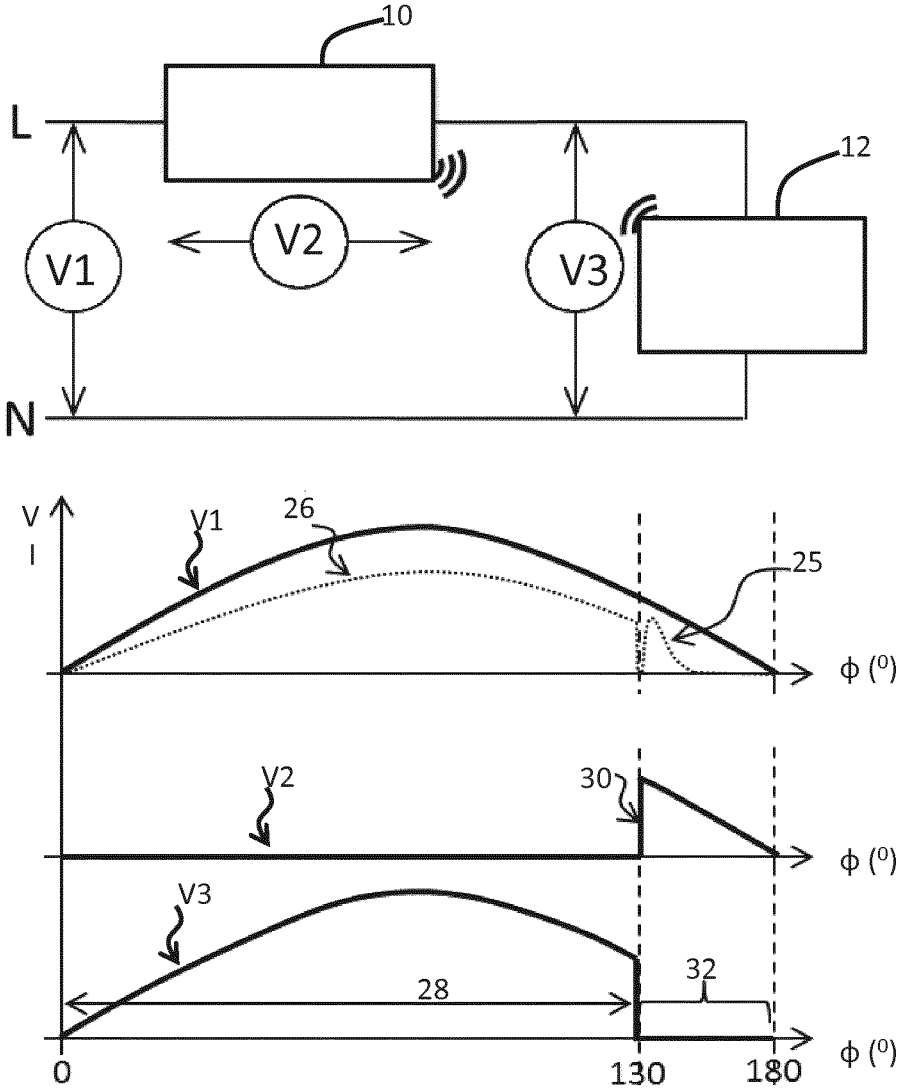
FIG. 2 is used to explain how the lighting apparatus control switch generates its own power supply.

As mentioned above, the lamp control switch 10 generates its own power supply. An example of how this may be achieved is explained with reference to FIG. 2.

The circuit of FIG. 1 is shown schematically, to show the mains supply voltage V1, the voltage V2 across the lamp control switch 10 and the voltage V3 across the lamp 12. One half cycle of the mains input V1 is shown in the timing diagram.

The lamp control switch 10 implements a trailing edge phase cut. Thus from 130 degrees to 180 degrees, the output voltage V3 is zero and the trailing edge of the mains input V1 appears across the lamp control switch as voltage V2.

Plot 25 is the power supply current of the lamp control switch and plot 26 is the operating current of the load.

During a first period 28, the load is powered in conventional manner. During period 30, phase cut dimming is used to create a differential voltage across the terminals of the lamp control switch. During period 32, the lamp needs to support the phase cut dimmer by passing a through current to charge the power supply of the lamp control switch. At the same time it should be able to withstand the trailing edge or leading edge phase-cut signals.

The phase cut dimming is carried out in conventional manner, and many examples of two-wire dimming circuit are known, for example triac-based circuits. With only two wires, the dimmer relies on the current passing through the load to both power its own internal circuitry and to detect zero-crossings for synchronization with the AC line.

When the lamp control switch is connected to a mains voltage for the first time, or when a first load is connected, it will try to start its power supply by phase cutting the mains voltage at a certain degree, for example as above. If insufficient power supply can be generated (for example because the load does not provide enough pass through current), the lamp control switch can only be used as an on/off switch.

If sufficient power supply can be generated, it will output a fixed phase angle (e.g. 130°). Subsequently, a wireless controllable lamp can be paired to the lamp control switch. In this case, the phase-cut will not be used for dimming but only to enable power supply generation to support RF communication and any other function in the control module that needs supply.

Figure 3A:
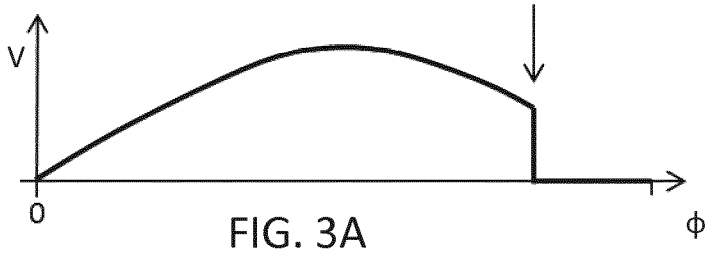
FIG. 3A shows how a fixed phase angle for a trailing edge phase cut may be used to provide a power supply function.

FIG. 3A shows how a fixed phase angle for a trailing edge phase cut may be used to provide a power supply function.

If no wireless controllable lamp is present or detected, the lamp control switch will enter one of its phase-cut dimming modes. The wireless communication will enter a sleep mode (very low power consumption) or shut down completely. The phase-cut is then not only used to generate power supply in the lamp control switch, but also to control the load by varying its phase-cut output.

Figure 3B:
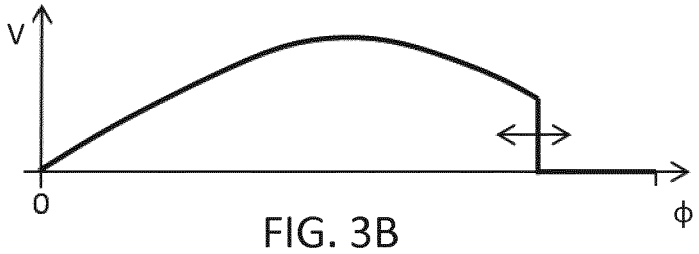
FIG. 3B shows how a variable phase angle for a trailing edge phase cut may be used to provide a power supply function and a dimming function.

As shown in FIG. 3B, this results in a variable phase cut.

Depending on the pass-through current capability of the load, the lamp control switch can possibly still respond to a remote control. This remote control signal can be used to vary the dimming level.

The phase-cut can of course never cover the full half-cycle, since still the power supply has to be maintained.

Figure 4:
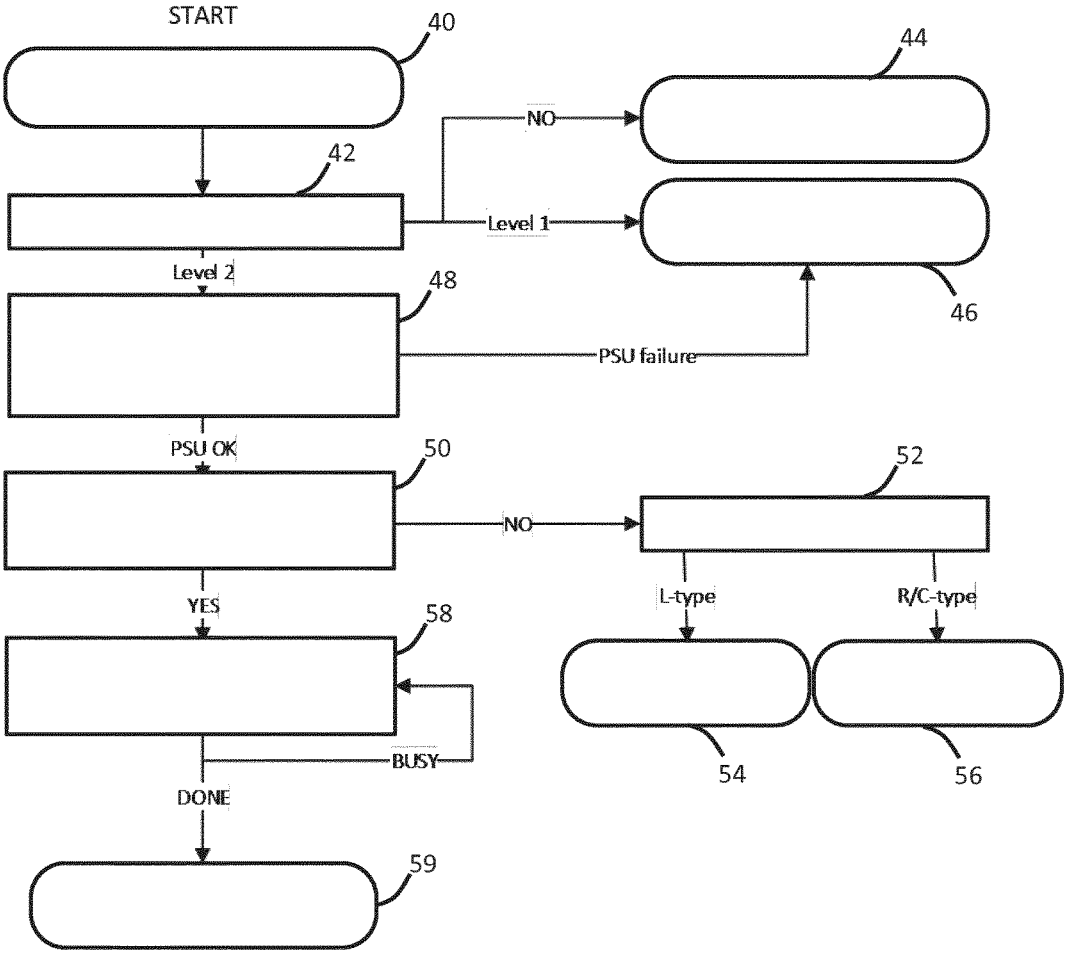
FIG. 4 show the method of configuring the lighting apparatus control switch.

FIG. 4 show the method of configuring the lamp control switch.

In step 40, the lamp control switch is installed or else the lamp is reconnected to the lamp control switch. Either event triggers the initialization.

In step 42 it is determined whether or not the power supply of the lamp control switch can charge properly. If not, a not working mode is detected in step 44 and an indication is provided to the user.

If the power supply is able to charge only to a first level (Level 1), the lamp control switch may only be operated in a switch mode, functioning as a mechanical on/off switch. This is determined in step 46.

If a second level of charge is reached, the lamp control switch is operated in phase cut mode (leading edge or trailing edge) in step 48, with a fixed phase angle for power supply generation. If the power supply is not then able to generate power from a phase cut signal, there power supply unit failure is detected and the method returns to step 46.

If the power supply unit is able to generate power from a phase cut signal, a test for wireless connectivity to the lamp is made in step 50. This is a test for commissioning of the lamp including registration communication, which may take several minutes.

If wireless communication is not possible, there is a test in step 52 for the type of wired dimmable load, such as resistive, capacitive or inductive. This type of load detection is well known, for example as described in EP1969691. If an inductive load is detected, a leading edge phase cut dimmer mode is used in step 54. If a resistive or capacitive load is detected, a trailing edge phase cut dimmer mode is used in step 56.

If wireless communication is possible, there is communication in step 58 during which system functionalities are identified, power needs are negotiated and front end connection is established. This is a commissioning method, which will be well known to those skilled in the art, for example as discussed in WO2007/029186 and WO2012/168859.

When the wireless setup is complete, the lamp control switch operates in RF mode in step 59 and functions as a bridge or hub.

Figure 5:
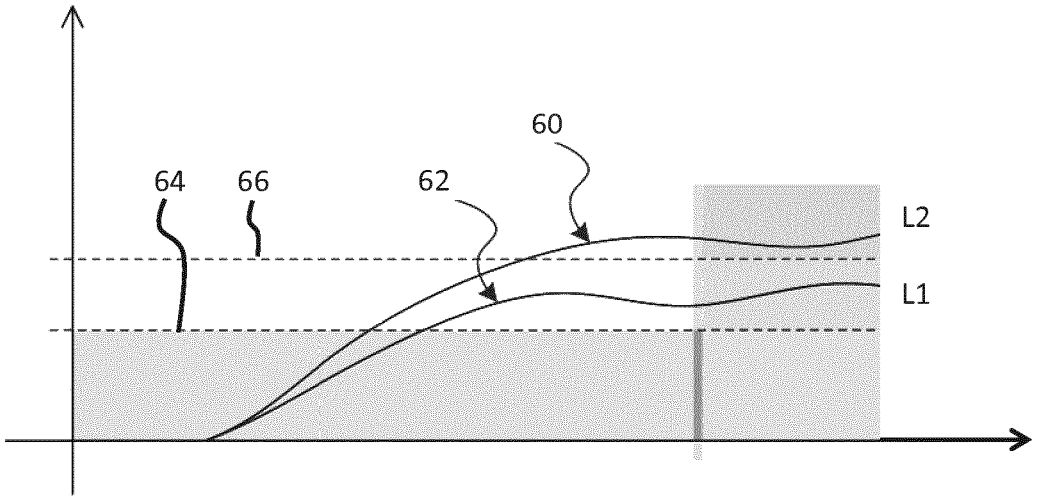
FIG. 5 shows how the power supply charging capability of the lighting apparatus control switch is used to determine in which state to operate.

In the initial decision step 42, the power supply charging capability of the lamp control switch, under the output current when the control switch is turned off, is used to determine in which state to operate. This is explained further with reference to FIG. 5.

After the starting point of installation or first load connection, the power supply in the lamp control switch phase cuts the mains input, and attempts to charge during the phase cut period, as shown by lines 60 and 62 as two individual examples. If the supply voltage can never reach the under voltage lock out (UVLO) level 64, the lamp control switch cannot start to operate (leading to step 44 above). An indicator LED on the lamp control switch can still be powered to indicate to the customer that the load is not compatible with this lamp control switch.

If the power supply can enter level L1 (the area between the UVLO level 64 and a mode detection threshold 66), it means the light load is a non-dimmable lighting load which does not allow enough bypass current, and the control switch only has sufficient supply to act as an on/off switch. If it can even enter a higher level L2 above the mode detection threshold 66 (as does line 60), it has sufficient supply to operate as a dimmer. The determination of whether the lamp control switch is to function as a phase-cut dimer or as a wireless hub is determined later in the process.

A boundary condition is that even a non-dimmable load should allow at least several milliamps of pass-through current to enable the lamp control switch to reach at least the UVLO level 64. Many, if not all, non-dimmable lighting loads do this.

A dimmable lamp needs to be compatible with a wall phase cut dimmer, and there is therefore a need for conducting the current in the phase cut period to charge the capacitor in the dimmer. For a traditional lamp like a compact fluorescent lamp, CFL, there is a bypass current inherently since it is a pure resistive load. For a dimmable LED lamp, because the LED driver/converter is not a pure resistive load, the driver by itself often does not provides the bypass current path, and that's why more and more dimmer-compatible dimmable LED lamps typically include a dedicated bleeder path. Thus, for proper performance, all phase-cut dimmable LED lamps now and future would have some means to bypass current in the non-conduction state and off-state.

If both a phase-cut dimmable lamp and a wireless controllable lamp are connected in parallel, the lamp control switch may operate in the wireless mode to create a fixed phase-cut for power supply and start RF communication. The phase cut dimmable lamp will not be dimmable and can only be switched on and off. For the wireless controllable lamp, only a power-controlled off-state is available in this case because a communication controlled off-state will not power off the phase-cut dimmable lamp.

Instead of using automatic detection, the operation mode selection can be made manually by the user.

An additional feature of the controller could be to temporarily change the conduction angle for power supply generation, for example if the wireless function needs more power than for normal operation (e.g. for an over the air (OTA) update). If for example the steady state phase angle for power supply generation is 145°, it could be altered to 130° for the duration that the additional power supply charging is required.

Optionally, a current sense element (e.g. a current sense resistor) may be provided in series with the switches M1 and M2. In this way, it can be determined whether or not the load is drawing current. If the current is below a certain threshold, the control unit can detect this and switch off the load. In this way, the lamp control switch can also act as a standby killer. Since the mains voltage is never physically disconnected from the wirelessly controlled lamps, standby losses exist and add up per lamp connected to the dimmer. To reduce the standby losses, the lamp control switch can in this way physically disconnect the lamps from mains, eliminating all the standby losses except for several hundreds of miliwatts from the universal dimmer itself. When a switch-on command is sent, first the dimmer will switch the mains and subsequently send the commands and previous settings to the lamps.

During the off-state, there is still some pass-through current available to power the supply unit so that the controller and/or wireless function block in an idle mode.

The lamp control switch may be applied to LED lamp or luminaires, CFL lamps or luminaires, incandescent lamps or luminaires and wireless controllable lamps or luminaires in a two-wire electrical installation.

A variety of use-cases and application specific conditions are possible. The invention provides a universal dimmer which automatically detects its load and is capable of working as on/off switch, phase-cut dimmer (leading and/or trailing edge) and as an RF node/hub/bridge.

The lamp may not be limited to lighting only. Various other functions such as acoustic functions, sensing functions, and image capture can be integrated into a lamp or luminaire. The lamp and luminaires can also house functionality which can be part of a larger system, e.g. heating, ventilation and air conditioning (HVAC) systems, load-shedding systems, and emergency and alarm security systems.

Where elements have been defined separately by their function, such as a detection circuit and a controller, this does not exclude that they may be implemented in practice as a shared physical entity. Any reference signs in the claims should not be construed as limiting the scope.

The invention claimed is:

1. A lighting apparatus control switch, comprising:

a series switch arrangement coupled between a power input terminal and an output terminal;

the power input terminal for receiving power from an external power source;

the output terminal for connection to a lighting load;

a detection circuit for detecting a parameter which is dependent on an output current flowing to the output terminal with the series switch arrangement turned off; and a controller, which is adapted to:

configure the lighting apparatus control switch as an on/off controller or a dimming controller according to the detected parameter by determining a type of lighting load based on the parameter, wherein the type of lighting load is determined to be a dimmable lighting load if the parameter exceeds a threshold (66), or a non-dimmable lighting load if the parameter is below the threshold and exceeds an under voltage out threshold; and configure the lighting apparatus control switch as the on/off controller for the non-dimmable lighting load or as the dimming controller for the dimmable lighting load.

2. A lighting apparatus control switch as claimed in claim 1, wherein the power input terminal is for receiving an alternating mains input, the controller is adapted to implement a phase cut to the mains input, and the series switch arrangement is adapted to be turned off in the phase cut, wherein the lighting apparatus control switch further comprises a charge storage element which is charged by said output current during the phase cut to provide a power supply for the detection circuit and controller.

3. A lighting apparatus control switch as claimed in claim 2, wherein the parameter comprises a state of charge of the charge storage element.

4. A lighting apparatus switch as claimed in claim 1, further comprising an RF transceiver, wherein the controller is further adapted to determine if the dimmable lighting load is an RF dimmable lighting load by attempting RF communication with the lighting load.

5. A lighting apparatus control switch as claimed in claim 4, wherein the controller is adapted to configure the lighting apparatus control switch as:

a wireless intermediary for an RF dimmable lighting load if the RF communication with the lighting load succeeds; otherwise as a phase cut dimmer if the RF communication with the lighting load fails.

6. A lighting apparatus control switch as claimed in claim 1, wherein the controller is adapted to switch off the load and/or display a notification if the parameter drops below a value smaller than an under voltage lock out threshold.

7. A lighting system, comprising a lighting apparatus control switch as claimed in claim 1 and a lighting load connected to the output terminal, wherein the lighting load comprises one of:

a phase-cut dimmable lighting load having a current bypass function;

a non-dimmable lighting load having no current bypass function; and a RF dimmable lighting load with RF communications capability and having a current bypass function.

8. A lighting apparatus control method, comprising:

detecting a parameter dependent on an output current flowing from a lighting apparatus control switch to a lighting load with a series switch arrangement turned off; and configuring the lighting apparatus control switch as an on/off controller if the parameter is below a threshold and exceeds an under voltage lock out threshold or a dimming controller if the parameter exceeds the threshold.

9. A method as claimed in claim 8, further comprising determining the type of lighting load based on the parameter by determining the lighting load to be a dimmable lighting load if the parameter exceeds a threshold, or a non-dimmable lighting load if the parameter is below the threshold.

10. A method as claimed in claim 9, further comprising determining if the dimmable lighting load is an RF dimmable lighting load by attempting RF communication with the lighting load and configuring the lighting apparatus control switch as a wireless intermediary for an RF dimmable lighting load if the RF communication succeeds.

11. A method as claimed in claim 9, further comprising receiving an alternating mains input to the lighting apparatus control switch and implementing a phase cut to the mains input, wherein the method further comprises charging a charge storage element from the input during the phase cut to provide a power supply, and wherein the parameter comprises a state of charge of the charge storage element.

* * * * *